US006114994A

United States Patent [19]

Soref et al.

[11] Patent Number: 6,114,994

[45] Date of Patent: Sep. 5, 2000

[54] PHOTONIC TIME-DELAY BEAMSTEERING SYSTEM USING FIBER BRAGG PRISM

[75] Inventors: Richard A. Soref, Newton, Mass.; Henry Zmuda, Niceville, Fla.

[73] Assignee: The United States of America as represented by the Secretary of the Air Force, Washington, D.C.

[21] Appl. No.: 08/961,450

[22] Filed: Oct. 30, 1997

[51] Int. Cl.[7] ..... H01Q 03/22

[52] U.S. Cl. ..... 342/372; 342/375

[58] Field of Search ..... 342/372, 375

[56] References Cited

U.S. PATENT DOCUMENTS 4,717,918 1/1988 Finken ..... 342/368
4,962,382 10/1990 Lee ..... 342/372
5,140,651 8/1992 Soret et al. ..... 385/2
5,461,687 10/1995 Brock ..... 385/37
5,583,516 12/1996 Lembo ..... 342/375
5,852,687 12/1998 Wickham ..... 385/14

*Primary Examiner*—Mark Hellner
*Attorney, Agent, or Firm*—Robert L. Nathans

[57] ABSTRACT

A one-laser technique for optical time-delay beamsteering of a microwave phased-array antenna in transmit-and- receive modes. Arrays of reflective, fiber Bragg gratings are employed and a modulated, wavelength-tuned laser excites prism-shaped arrays of chirped or single-frequency gratings deployed inside a set of N parallel fibers. The fiber gratings can be replaced by waveguided gratings within a semiconductor chip for operation at high microwave frequencies.

5 Claims, 11 Drawing Sheets

PHOTONIC TIME-DELAY BEAMSTEERING SYSTEM USING FIBER BRAGG PRISM

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of phased array antenna control systems. Optical control of phased array antennas offers important advantages of size, weight, bandwidth, low propogation loss, immunity to electromagnetic radiation, remoting capability and simplified transmit/receive modules. Prior art systems require a large number of precisely time-delayed matched optical elements such as lasers and optical delay segments. The dispersive fiber prism proposed and tested by Esman et al is a convenient means for true time delay (TTD) beamsteering of a phased-array microwave antenna. See Esman, R. D. et al., "Fiber-optic Prism True Time-delay Antenna Feed," IEEE Photonics Technology Letters, 5: 1347. The advantage of that dispersive fiber prism is that it requires only one tunable laser source, compared to the multiple sources needed in the uniform fiber-dispersion approach; see Soref, R. A., 1992, Optical Dispersion Technique for Time-delay Beamsteering, Applied Optics, 31: 7395. However, this approach requires very long lengths of fiber which is undesirable.

Thus, there is a need for an electro-optic transmit and receive phased array antenna control system utilizing a single tunable laser source and employing much shorter lengths of fiber than needed for the dispersive fiber prism approach. There is also a need for such a system that can be readily implemented in the form of a photonic integrated circuit.

BRIEF SUMMARY OF PREFERRED EMBODIMENTS OF THE INVENTION

A key aspect of the invention is the utilization of a grating prism in the form of an array of progressively spaced reflective Bragg gratings within a set of optical conduits comprising optical fibers or waveguides. A single RF modulated tunable laser introduces simultaneous beams into the grating prism conduits and a series of reflected wavefonns are produced having time delays proportional to the laser wavelength. These reflected waveforms produce antenna beamlet control of the antenna elements of a phased array RF system. A receiver is provided having similar structure but which has a single photodetector coupled to the grating prism via a power combiner for receiving the incoming RF signal from a direction controlled by the laser wavelength.

BRIEF DESCRIPTION OF THE DRAWINGS

Other features and advantages of the invention will become apparent from study of the following description, taken in conjunction with the drawings in which.

DETAILED DESCRIPTION OF PREFERRED EMBODIMENTS OF THE INVENTION

Figure 1:
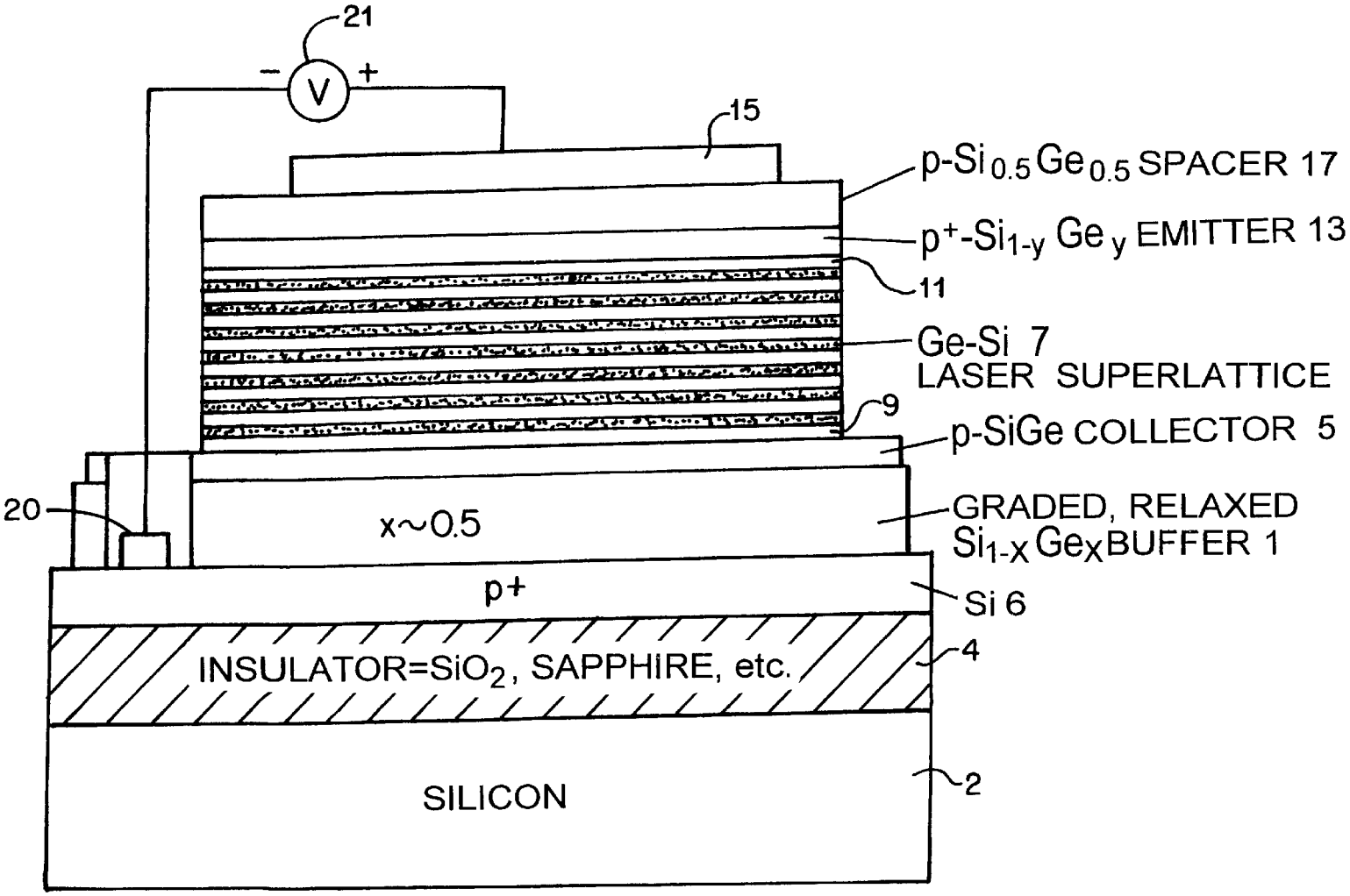
FIG. 1 schematically shows TTD apparatus for producing microwave beam transmission control signals.

FIG. 1 shows a microwave beam transmission control apparatus which employs the programmable wavelength-dependent TTD fiber demonstrated by Ball et al and Molony et al. See IEEE Photonics Technology Letters, 6: 741 and Electronics Letters, 31: 1485., respectively. One tunable laser TL1, modulated by a broadband microwave modulation signal from signal source 2, feeds a group of N single-mode time-delay fibers 5 through an equal-path 1:N tree-type power divider 7 integrated in a photonic integrated circuit chip 9. Each fiber includes a spatially distributed array of M single-frequency reflective Bragg gratings 11, such gratings being described by Ball et al., supra. M and N are integers greater than one and M=5 in this illustration. The resulting fiber grating prism is designated GP 6 in the figure.

The different peak-reflection wavelengths of the various gratings are within the tuning range of the tunable laser 1. Chip 9 includes a N-fold set of integrated 3 dB directional couplers 13 that gather back-traveling light signals from the wavelength-selected reflective gratings 11 of GP 6. Reflected light is time-delayed in accordance with the particular gratings of GP 6 addressed and thus rendered reflective by the variable frequency light beam emitted by tunable laser TL 1. A second set of equal-length fibers 15 coupled to outputs 10 of the directional couplers transports the N directional coupler outputs from directional couplers 13 to a set of N spectrally broad photodiodes 17. The photodetectors recover the N individually delayed microwave signals that feed, via amplifiers 22, the N antenna-radiator elements 19, for transmission of the outwardly propogated directional beamlets 20, making up the main lobe of the radiated beam. Three-dimensional beamsteering in azimuth and elevation is obtained by stacking the planar arrays including GP 6 of FIG. 1. An important benefit of our arrangement is that the lengths of fiber required for the grating arrays of GP6 can be much smaller than those needed in the aforesaid dispersion systems.

Figure 2:
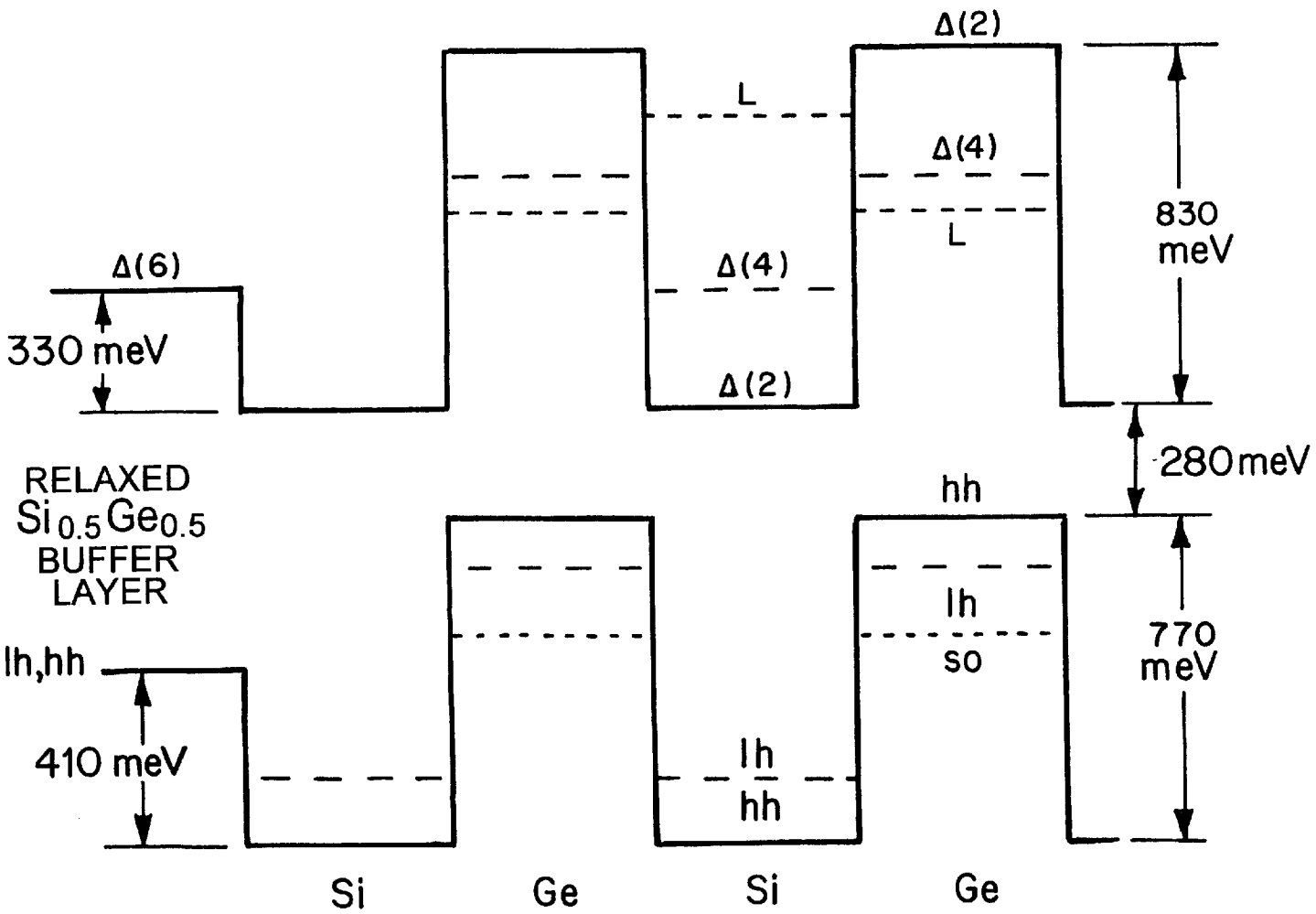
FIG. 2 shows aspects of beam direction control.

FIG. 2 illustrates a spatial layout of the fiber Bragg gratings 11 for the N=4 fiber example. Here, the main lobe of the phased-array antenna can point in any one of five discrete directions (M=5) selected by the agile tunable laser TL 1. The dashed lines show the progressive separation of neighboring gratings 11 within fibers 5 and from fiber to fiber. Note that the number of gratings in each fiber is M=5 and how the grating spacing progressively increases from one fiber to the next. The labels show how the reflection wavelengths are assigned to the five gratings per fiber. The angle $\theta 3=0$ shows the "broadside" radiation condition. Steering angles $\theta 1$ and $\theta 2$ are negative with respect to broadside, while angles $\theta 4$ and $\theta 5$ are positive.

Figure 3:
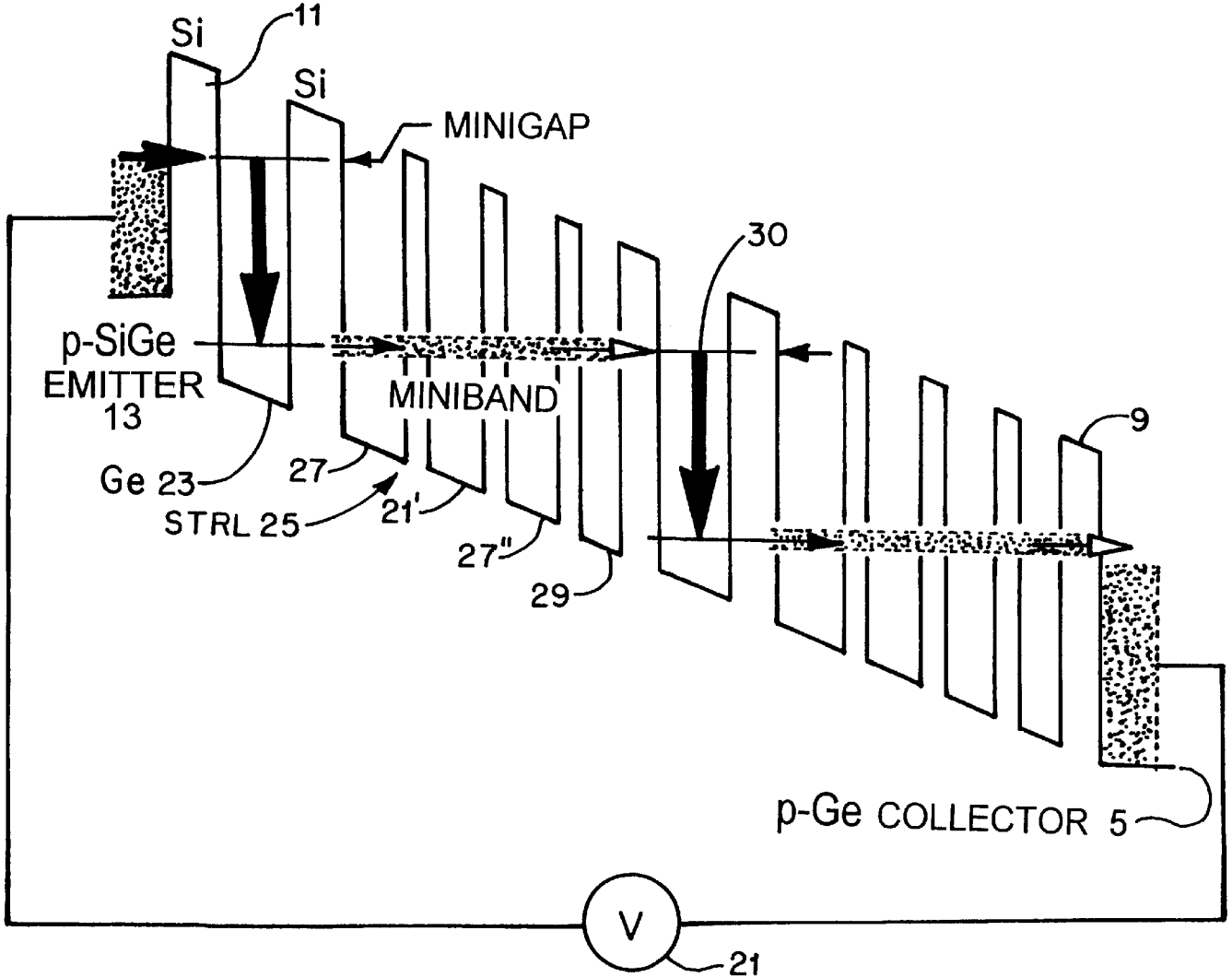
FIG. 3 shows aspects of continuous chirped fiber gratings.
Figure 3A:
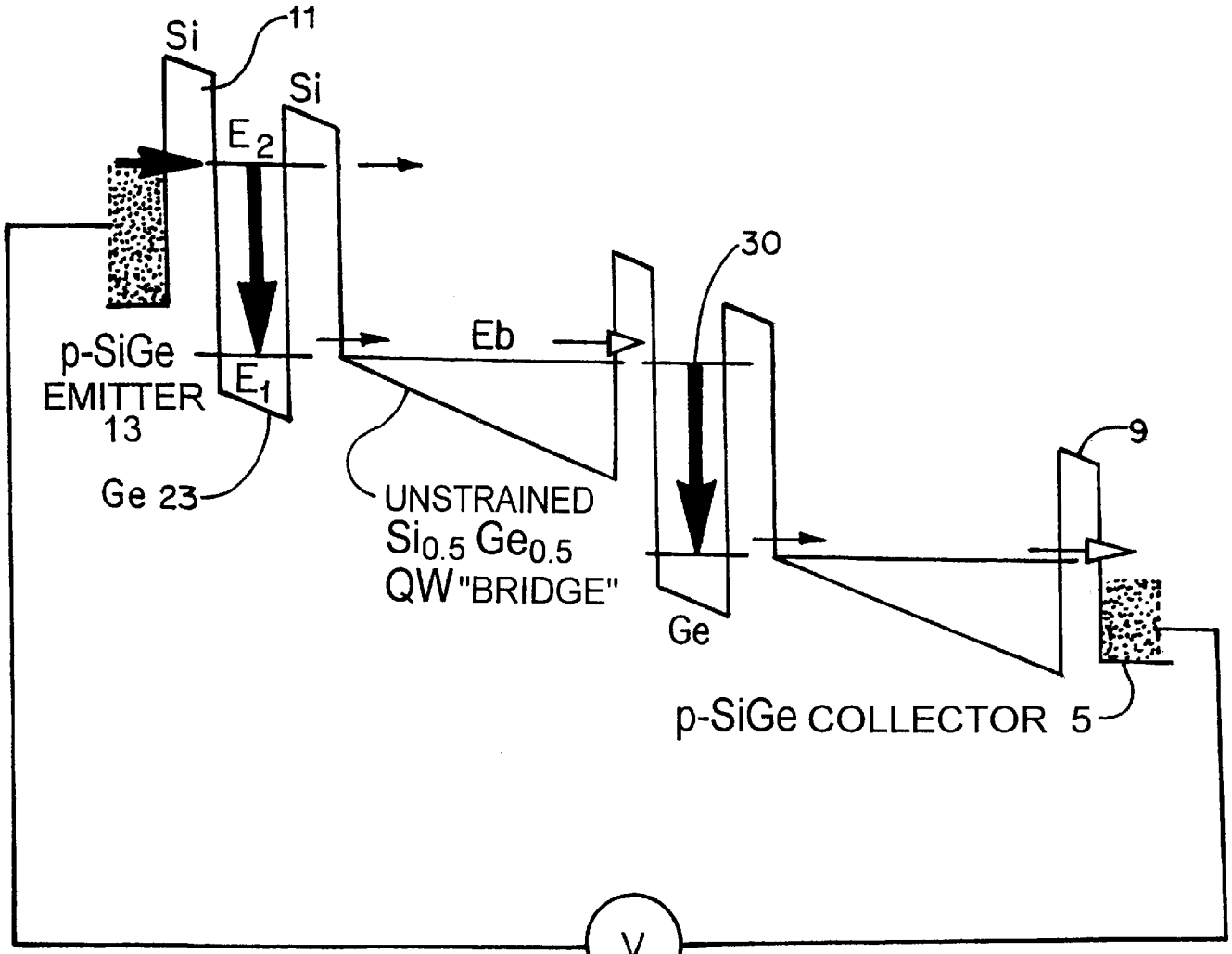

Because continuous beamsteering is often required rather than discrete steering, we propose a technique in FIG. 3 that uses the chirped fiber-Bragg gratings discussed by Molony et al., supra. The N=4 example is illustrated Here each fiber 5 contains a variable-pitch chirped grating 11' that extends typically over several centimeters for the outer fibers in the array. The peak (narrowband) reflection wavelength of this broadly chirped grating varies with the spatial coordinate along the fiber. The reflection wavelength is 1*a* at one end of the grating and is 1*b* at the other end, as shown. The dashed lines illustrate both the progressive change in grating length from fiber to fiber, and the angular range for continuous steering of the radiation beam at angles above and below broadside. If Z is the length of the smallest chirped grating in FIG. 3, then $Z=(c/2nf_m)\sin\theta_{max}$, where c is the light speed, n is the refractive index of the waveguide, $f_m$ is the maximum microwave frequency, and $\theta_{max}$ is the maximum steering angle with respect to broadside. There is a tradeoff as Z decreases: the spectral bandwidth of the reflection becomes broader.

Regarding system loss, the laser power reaching the photodiodes 17 in FIG. 1 is R/4N, where R is the grating reflectance and the factor ¼ refers to the 6 dB coupler loss per channel. The reflectance of each addressed selected grating 11 within each optical conduit is about 90%. The M-1 unselected gratings per channel do not introduce appreciable optical loss because light travels forth-and back through those unaddressed and thus non-reflective gratings with little attenuation at wavelengths away from resonance.

Figure 4:
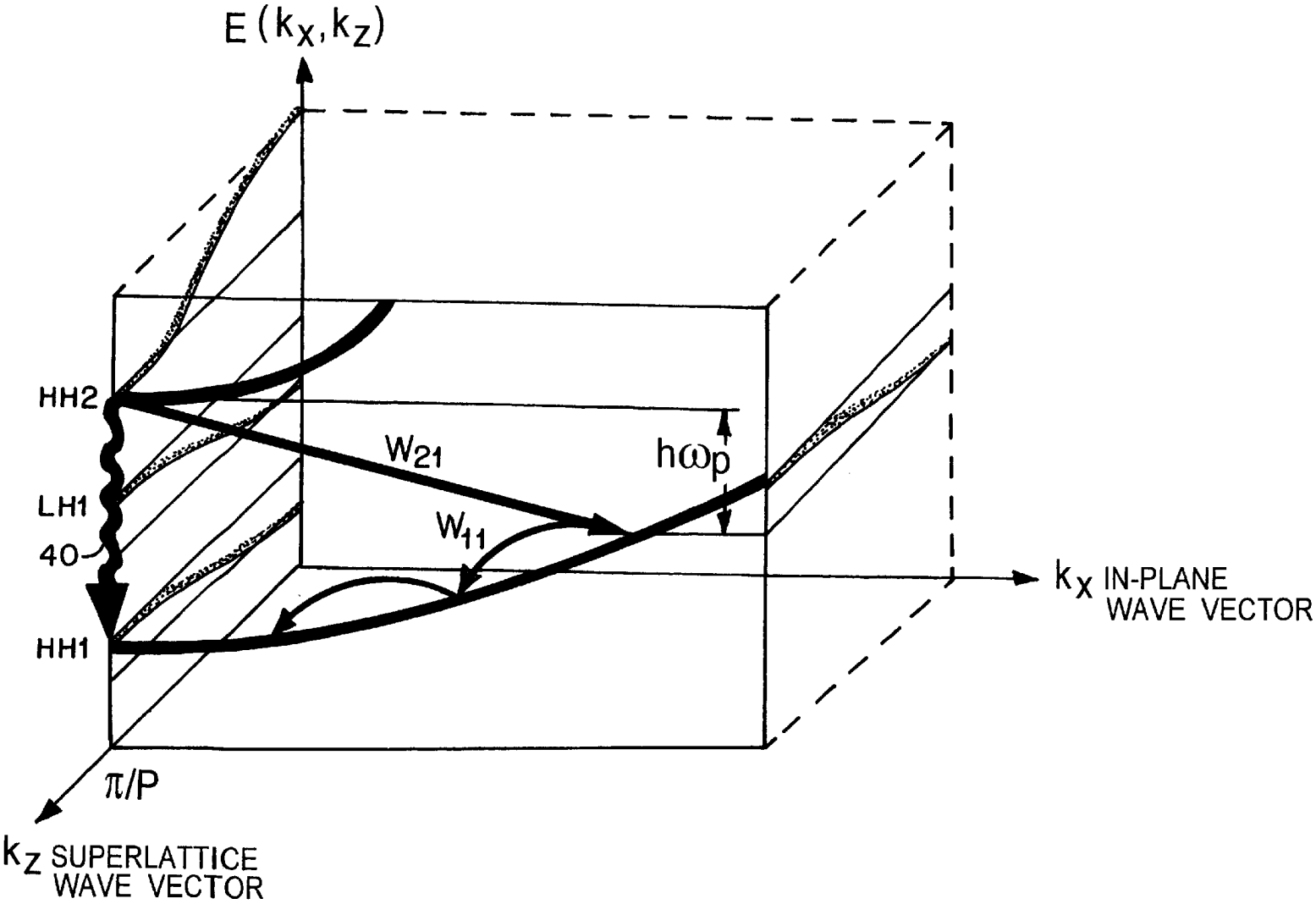
FIG. 4 shows aspects of grating separations needed at the smallest beamsteering angle.

If we draw an diagram of N in-line radiators, it is easy to see that a uniform phase front propagating in the direction $\theta_{min}$ of FIG. 4 will emerge from the N wavelets if the (equal) time step $\Delta t_{min}$ between adjacent radiators is:

$$\Delta t_{min}=(\tfrac{1}{2}f_m)\sin\theta_{min}. \quad (1)$$

FIG. 4 illustrates the minimum beamsteering angle $\theta_{min}$ in our prism steerer. Here d is the minimum physical separation between gratings 11. The progression of grating separations from one fiber to the next is: d, 2d, 3d, 4d, etc. The minimum time step is FIG. 4 is $$\Delta t_{min}=2dn/c \quad (2)$$

which is the double-pass delay to-and-from the next grating. From Eqs. (1) and (2), $d=(c/4nf_m)\sin\theta_{min}$. For example, d=1.7 mm and $\Delta t_{min}$=17.4 psec, when n=1.5, $f_m$=2 GHz and $\theta_{min}$=4°. In situations where d becomes less than the grating length $L_g$, there may be a problem in resolving adjacent delays. This crosstalk problem awaits further study. The practical limit is probably $d=0.5\ L_g$. If the grating separation is uniform within each fiber, then we find that the maximum length of fiber $L(max)=N(M-1)d+ML_g$ where M is the number of beam positions and N is the size of the antenna array. The minimum length $L(min)=(M-1)d+ML_g$. It is interesting to note that the steering angle θj is a nonlinear function of grating separation Dij because $D_{ij}/D_{ij}-1=\theta_j/\theta_j-1$.

Molony et al.[4] cite relations for the optical bandwidth δλ of the Bragg reflection, and the maximum resolvable number r of discrete time delays as follows:

$$\delta\lambda=\lambda o^2/2nLg \quad (3)$$

$$r=\Delta\lambda/3\delta\lambda \quad (4)$$

where $\lambda_o$ is the laser's center wavelength and Δλ is the laser's tuning range. From Eqs. (3) and (4), $r=2nLg\Delta\lambda/3\lambda_o^2$. For example, r=41 when n=1.5, Lg=2 mm, Δλ=50 nm, and $\lambda_0$=1550 nm. We shall choose M≦r.

Figure 5:
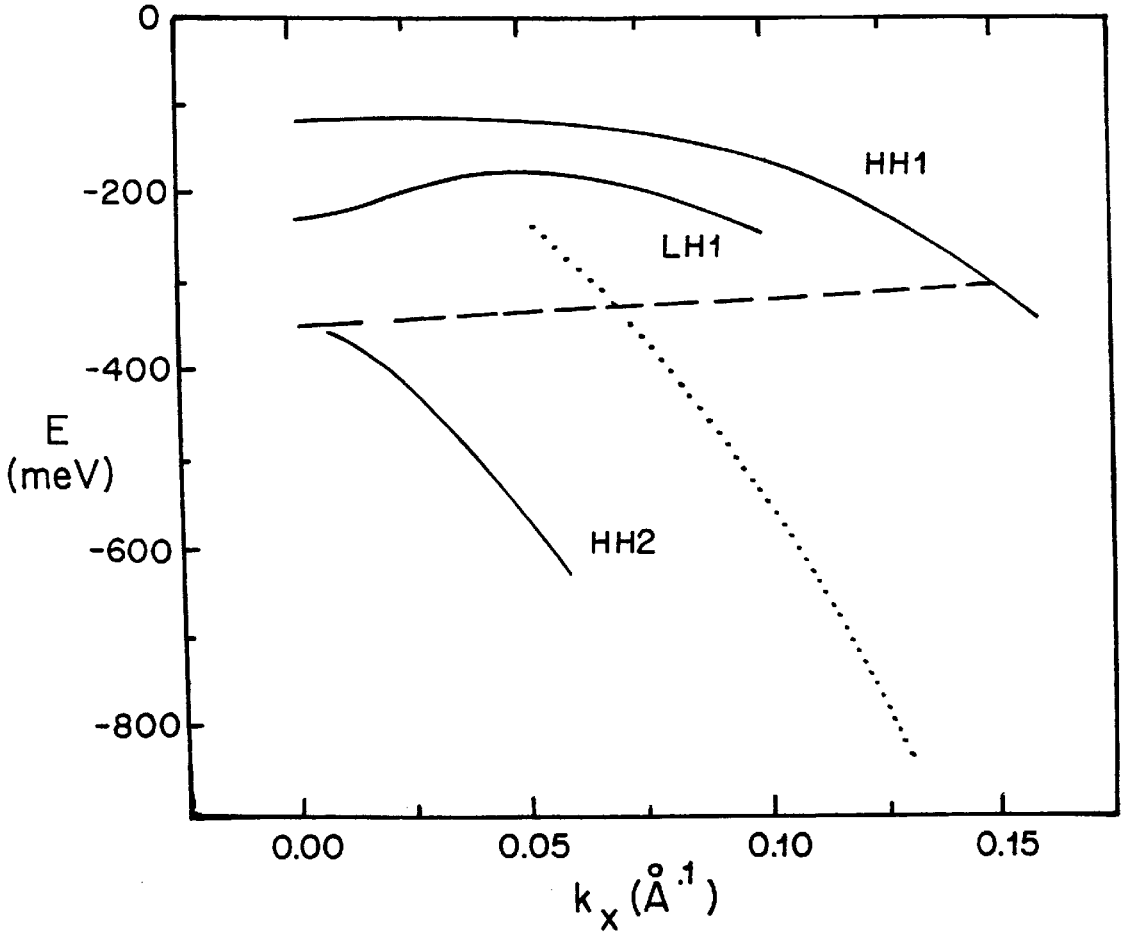
FIG. 5 indicates aspects of calculated dependence of resolution upon frequency for several minimum angles, assuming Lg=2d, $\lambda$=1550 nm and $\Delta\lambda$=50 nm, to be explained.

Under the constraint, $d=0.5\ L_g$, let us find how r and M depend upon $f_m$. We begin with $r=4nd\Delta\lambda/3f_m\lambda_o^2$ and substitute $d=(c/4nf_m)\ \theta_{min}$ to obtain $r=(c\Delta\lambda/3f_m\lambda_o^2)\sin\theta_{min}$. This beamsteerer resolution has been plotted in FIG. 5 as a function of $f_m$ for $\theta_{min}$=1°, 2°, and 4°. FIG. 5 illustrates the "modest" resolution at the high microwave frequencies. The number of usable beam positions is constrained by the M=r limit and by the angular scan limit $\theta_{max}$. If we assume a nonlinear progression of grating spacings within each waveguide in a manner that produces uniform angle steps, then $\theta_{max}=[(M-1)/2]\theta_{min}$, where $\theta_{max}$ is measured from the broadside line, M is odd, and the scan range is $2\theta_{max}$. If $\theta_{max}$=60°, then M=121, 61, and 31, for $\theta_{min}$=1°, 2°, and 4°, respectively. Thus, the full range of r in FIG. 5 is usable for 1° , but only r≦61 and r≦31 are usable for 2° and 4°, respectively.

For operation at 30 to 60 GHz, the (optional) fiber-dispersion prism shown in FIG. 1 can be used. Each "connector fiber" comprises a length of high-dispersion fiber spliced to a length of "non-dispersive" fiber. The overall length of each connecting fiber is the same, but the dispersive lengths change progressively across the fiber array1. This arrangement allows the subtraction of two cascaded time-shift profiles, one profile from reflection and the other from transmission. The subtraction produces smaller time steps $\Delta t_{min}$ than those obtained only by reflection (Eq. 2): for example, $\Delta t_{min}$=2 psec. However, the dispersive fibers cause the composite delay to become non-monotonic with wavelength, that is, a stair-step dependence with individual stair treads tilted.

Figure 6:
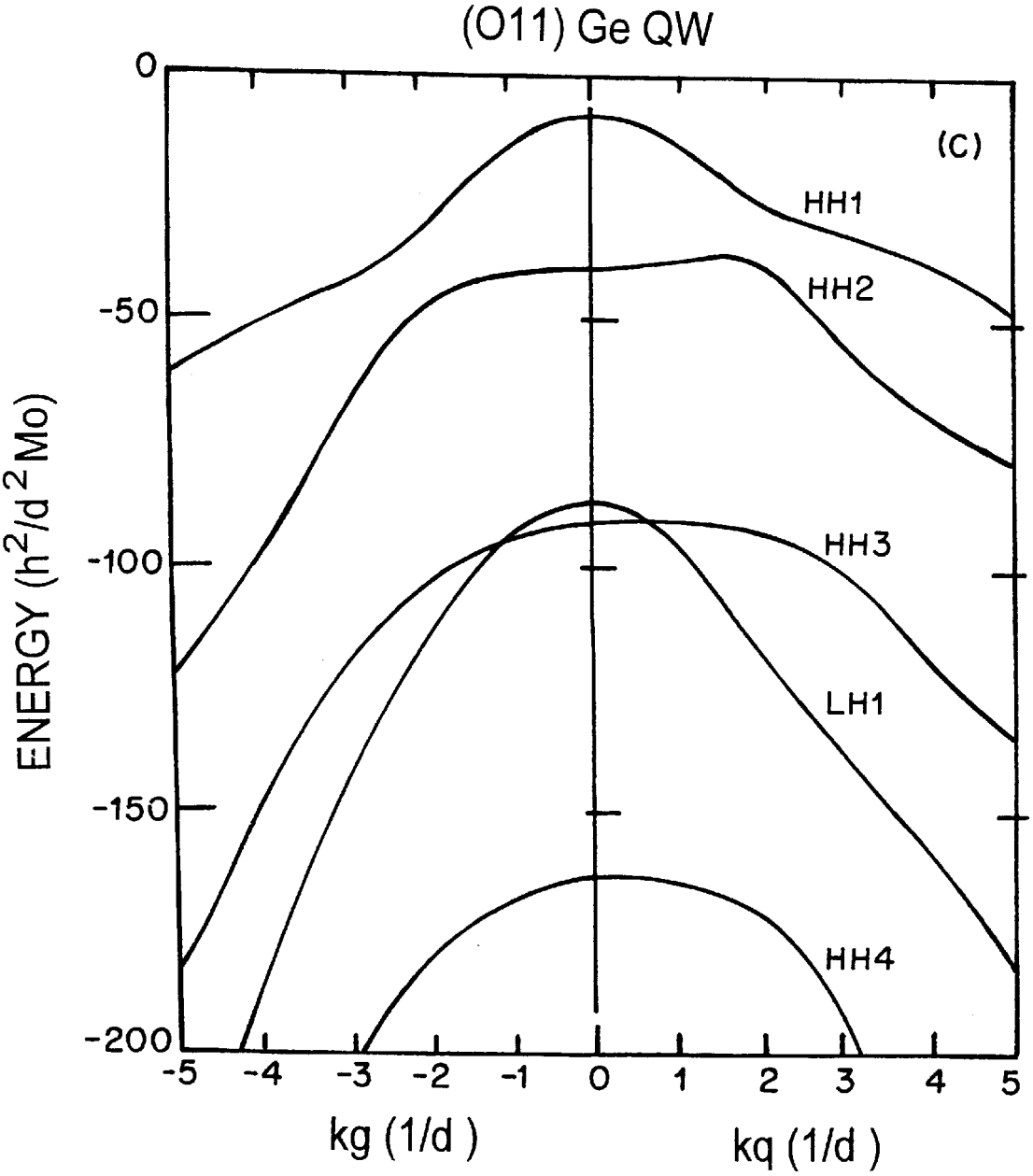
FIG. 6 schematically shows apparatus for the receiving mode of a fiber-Bragg TTD phased-array antenna steerer.

FIG. 6 schematically illustrates an embodiment of the incoming RF signal receiver employing present invention. An unmodulated continuous wave tunable laser, which could be a diode laser, TL 23, is located at the antenna plane and feeds N optical channels 25 via power divider 7' during the antenna plane and feeds N optical channels 25 via power divider 7' during the "listening" period for the incoming RF signals 20' retrieved by antenna elements 19. The various incoming microwave signals 20 from antenna elements 19 are sent via amplifiers 19' to an integrated group of N electrooptic modulators EOM 27 capable of high-speed operation. The modulated optical carriers are sent over fiber cable 29 to the remote-control station where those lightwaves enter a bank of N fiber Bragg grating reflector arrays of the grating prism GP 6. Next, the reflected lightwaves are gathered together by directional couplers 33 and sent to a photodiode 35 via fiber 34 for recovery of the collective microwave signal. Wavelength shift in the tunable laser diode TL 23 selects a particular "listening" incoming beam direction. In essence, the reflective Bragg array of GP6 is a matched filter. A large RF output at photodiode PD 35 occurs when the inbound microwave direction matches the wavelength-selected "listening" beam direction. The required $\Delta t_{min}$ is a few picoseconds at high microwave frequencies such as 20 to 50 GHz. Then the required grating separations in FIG. 2 are a fraction of a millimeter and the overall waveguide lengths in both FIGS. 2 and 3 are a few centimeters. Because of those dimensions, a semiconductor chip will be large enough to contain all of the needed waveguided reflectors, and thus fiber gratings can be eliminated. For the on-chip delay case, several low-cost, low-loss optical rib waveguides are available, such as: silica on silicon, silicon-on-insulator, and SiGe on Si. Silicon wafers with 4-inch and 8-inch diameters are offered commercially; thus they are excellent waveguide- delay substrates. Via E-beam lithography or other lithographic techniques, surface corrugation gratings with the necessary sub-micron periodicity can be fashioned in the aforementioned rib guides.

Figure 7:
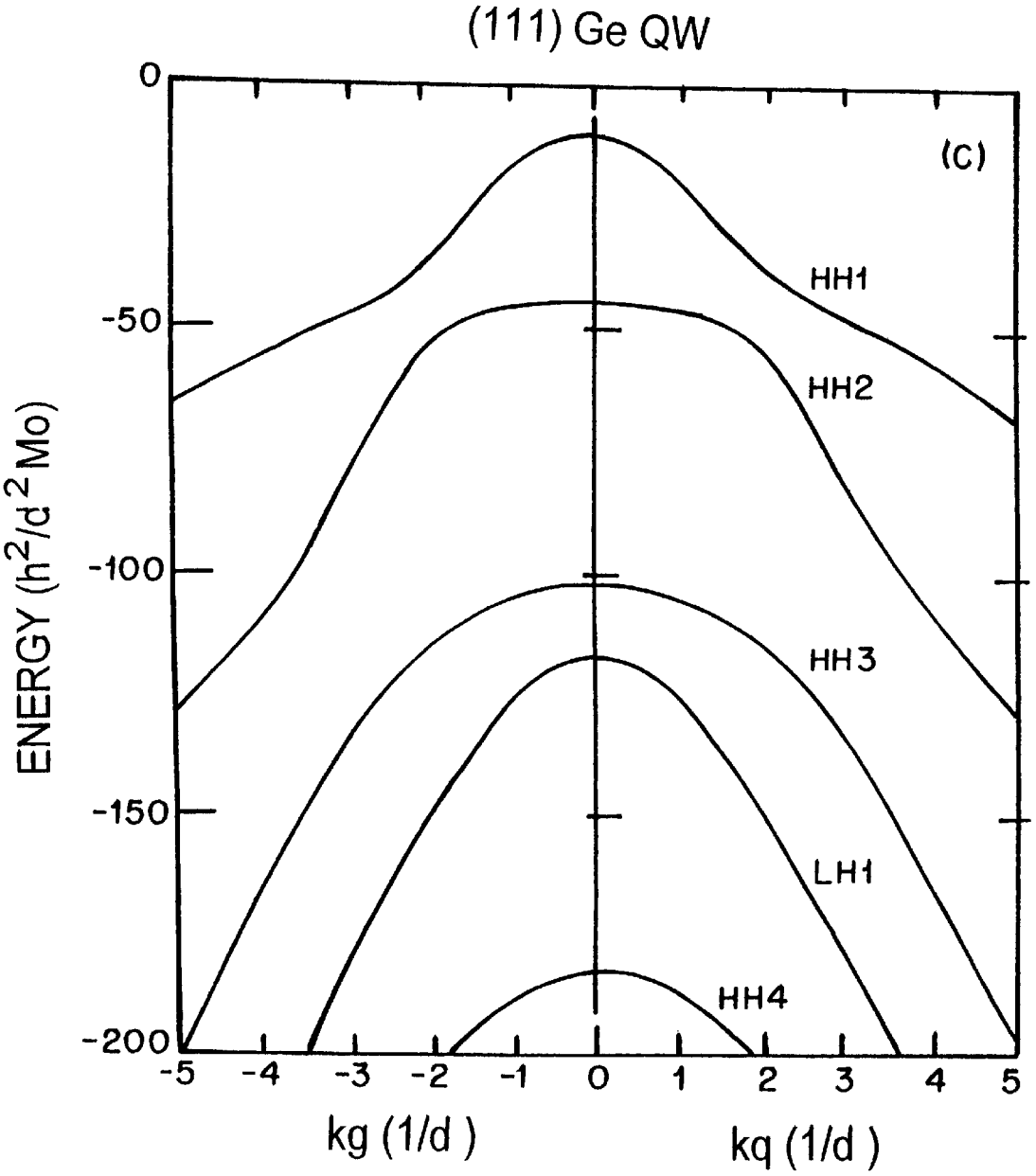
FIG. 7 schematically shows an on-chip waveguide-Bragg-prism TTD beamsteerer with tuned laser.

FIG. 7 schematically indicates a semiconductor on-chip TTD beamsteerer for the transmit mode. The microwave-modulated agile laser output from components 2 and 1, is power-divided on-chip with equal paths, among N channel waveguides 5' containing integrated Bragg reflectors 11. The back-traveling light in those channels is sent to the end of the chip where those beams are directly coupled into a "ribbon" 15 of optical fibers that go to the antenna plane.

Figure 8:
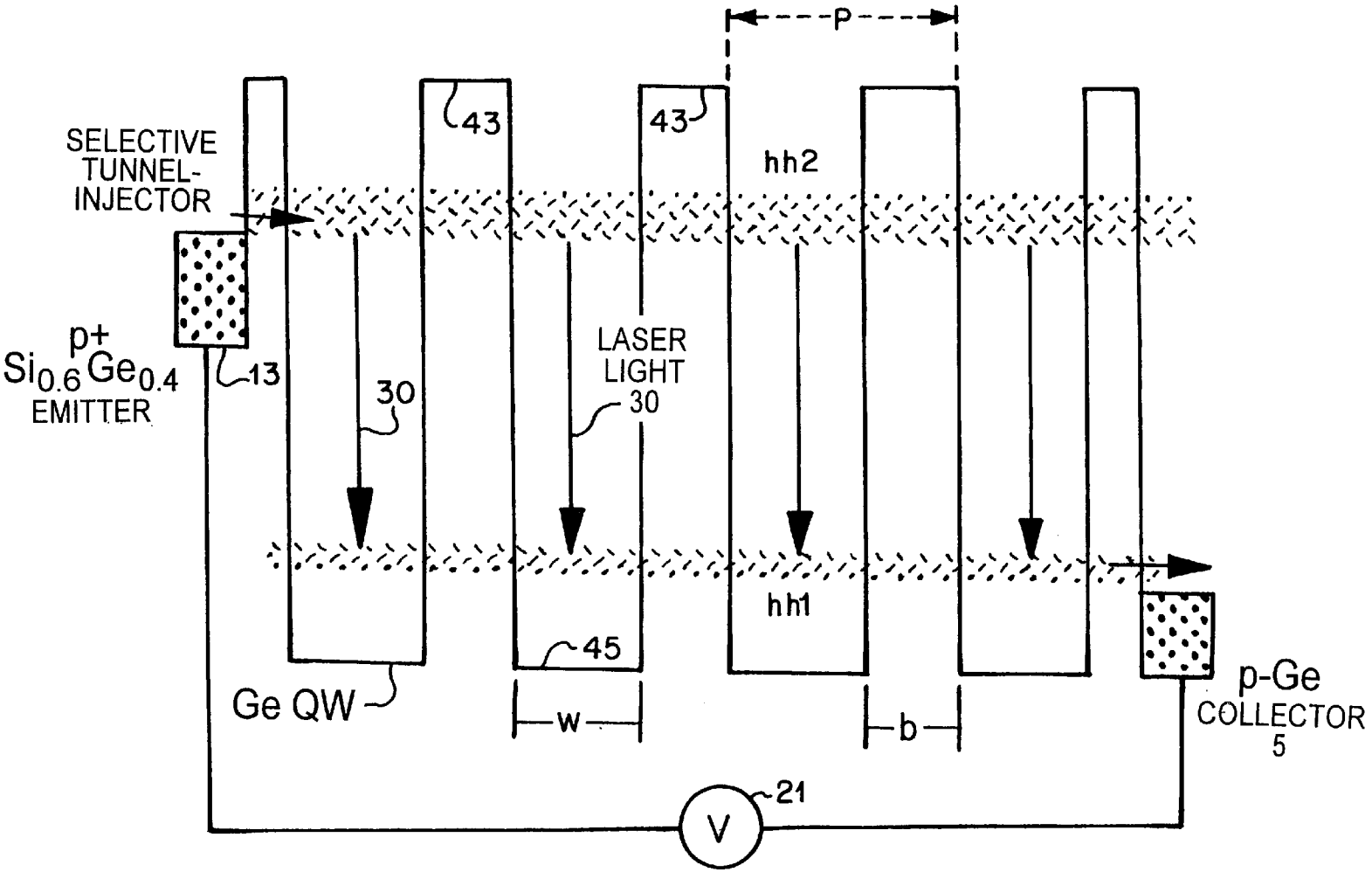
FIG. 8 shows an on-chip switched-waveguide prism TTD beamsteerer with a fixed frequency laser.

Instead of scanning the wavelength of the laser source, we can keep the source wavelength produced by source 2 and laser diode 1' of FIG. 8 fixed, and use optical switching devices 11 ' distributed along the various waveguide paths to select desired time delays. FIG. 8 illustrates an on-chip optical TTD beamsteerer in which electrooptical switching elements are deployed within the N channel waveguides 5. These switches are spatially grouped in prismatic form as before. Each of M×N electrically controlled waveguide elements 11' have two states: high reflection at the laser wavelength, or low reflection with high transmission. These variable reflectors can be index-modulated Fabry-Perot resonators described in U.S. Pat. No. 5,140,651 issued to Richard A. Soref and Henry Taylor, or Bragg gratings whose peak reflection wavelength shifts with injection current.

Figure 9:
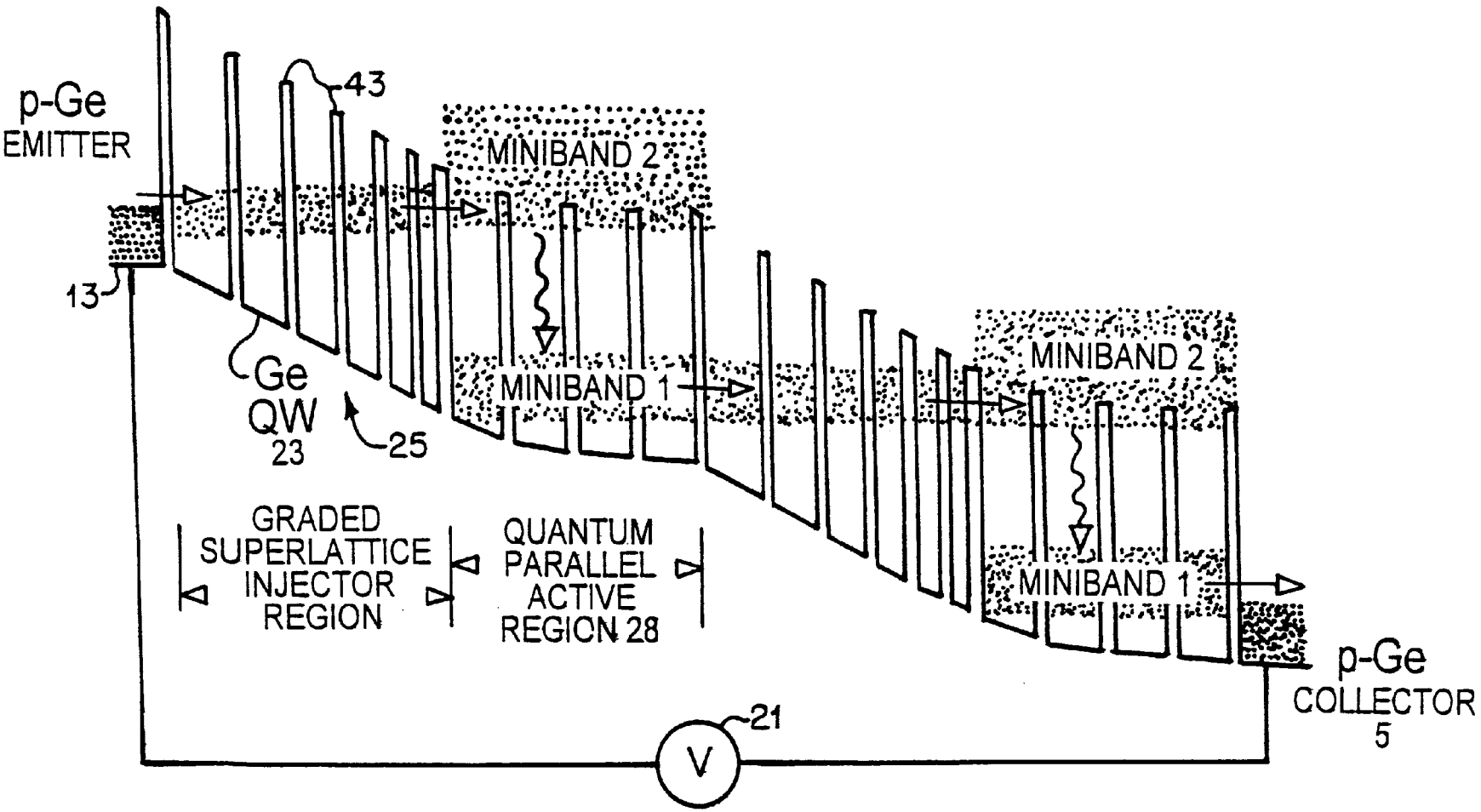
FIG. 9 schematically shows an on-chip optical/microwave transversal filter with RF agility.

The designs presented here can be extended to tunable optical/microwave transversal filters. As illustrated in FIG. 9, an agile RF filter is constructed by combining the N coupler outputs in FIG. 7 into a single output at waveguide portion 37. The composite optical signal, when demodulated by photodiode 39, produces nulls or passbands in the RF spectrum.

Figure 10:
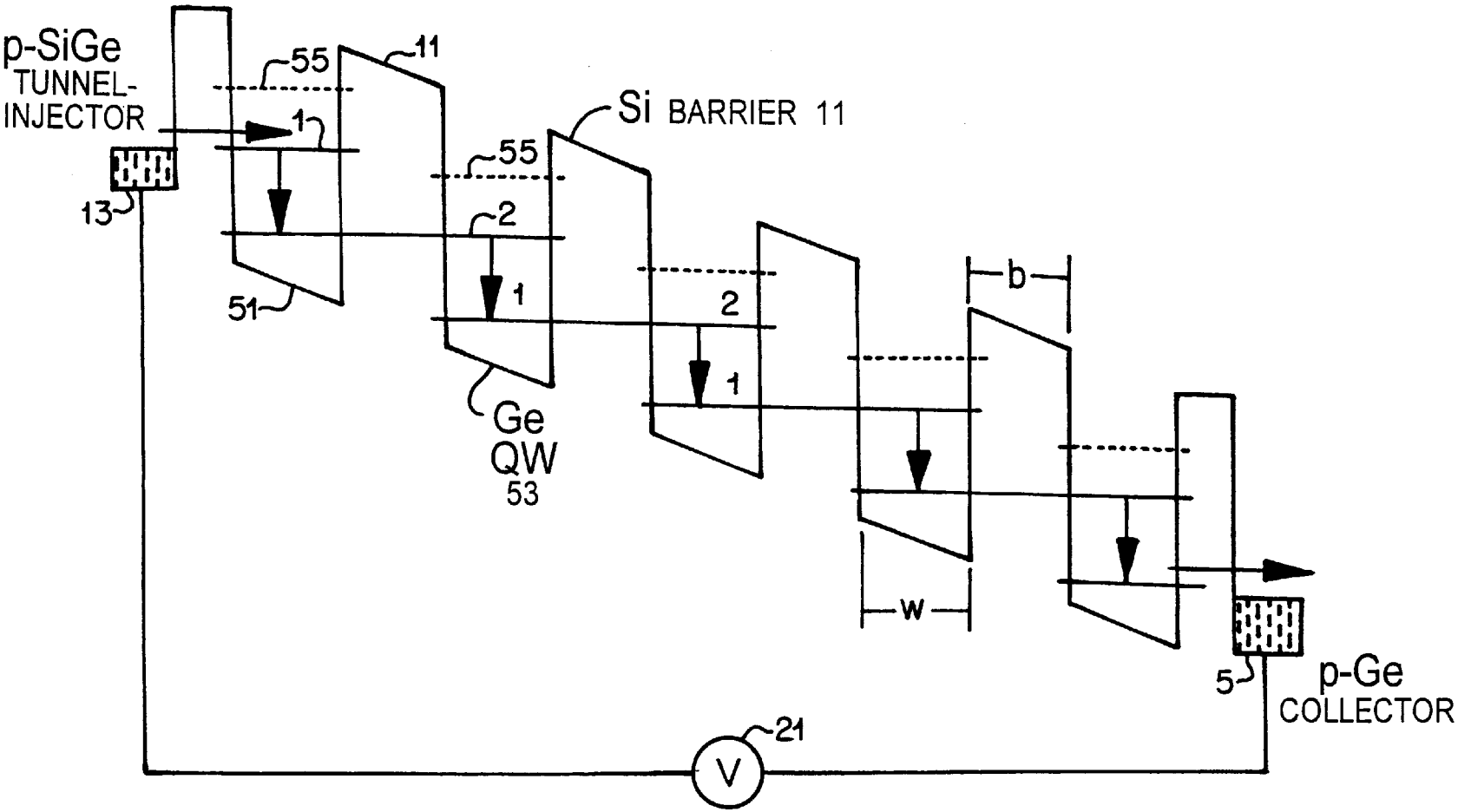
FIG. 10 schematically illustrates a transceiver improvement for performing both the RF transmit and receive functions in accordance with the invention.
Figure 1:
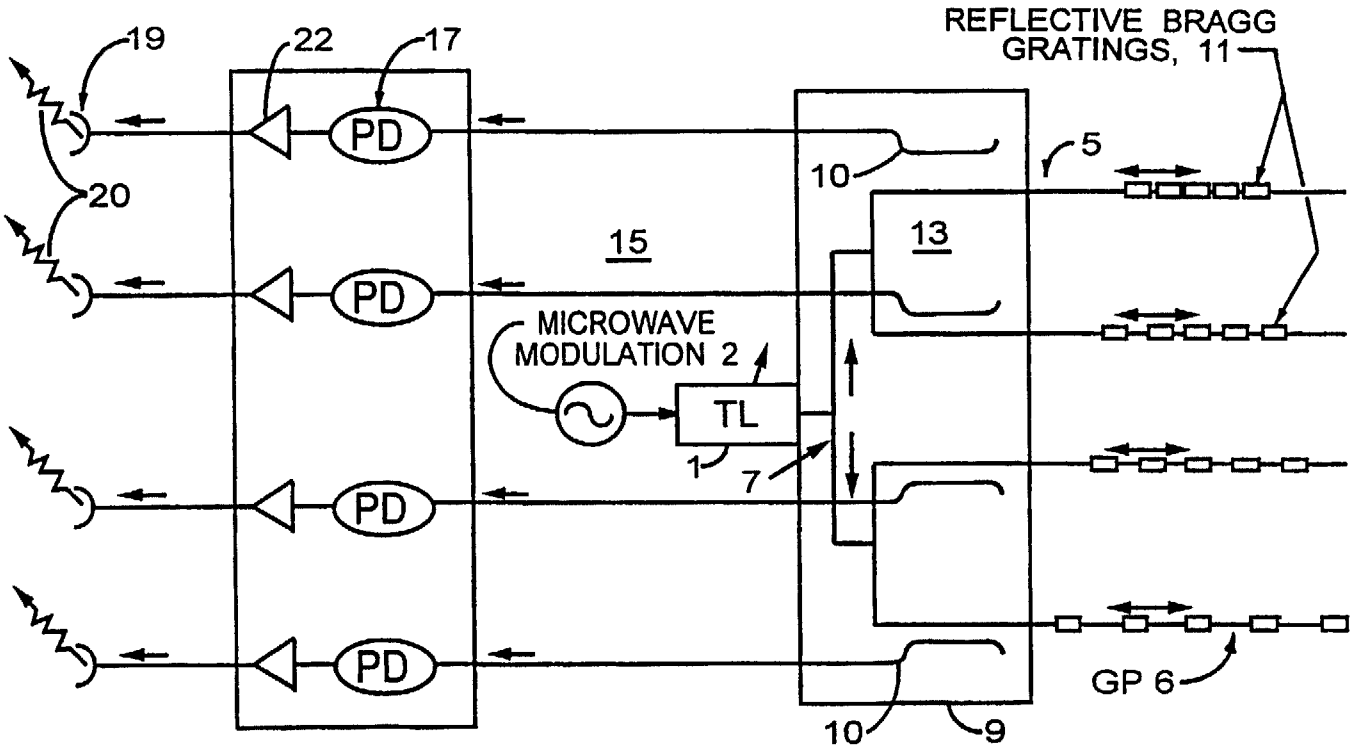
Figure 2:
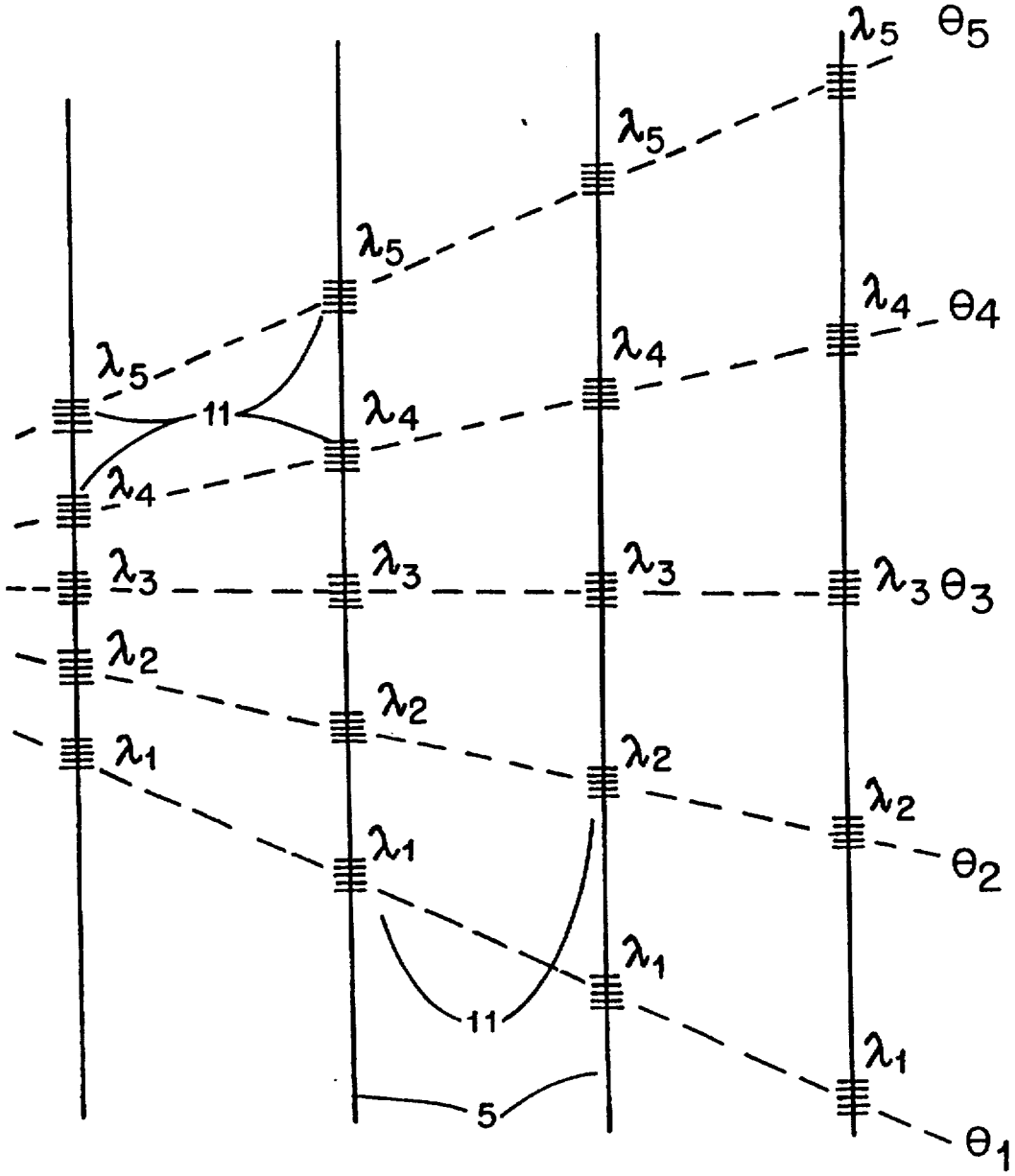
Figure 3:
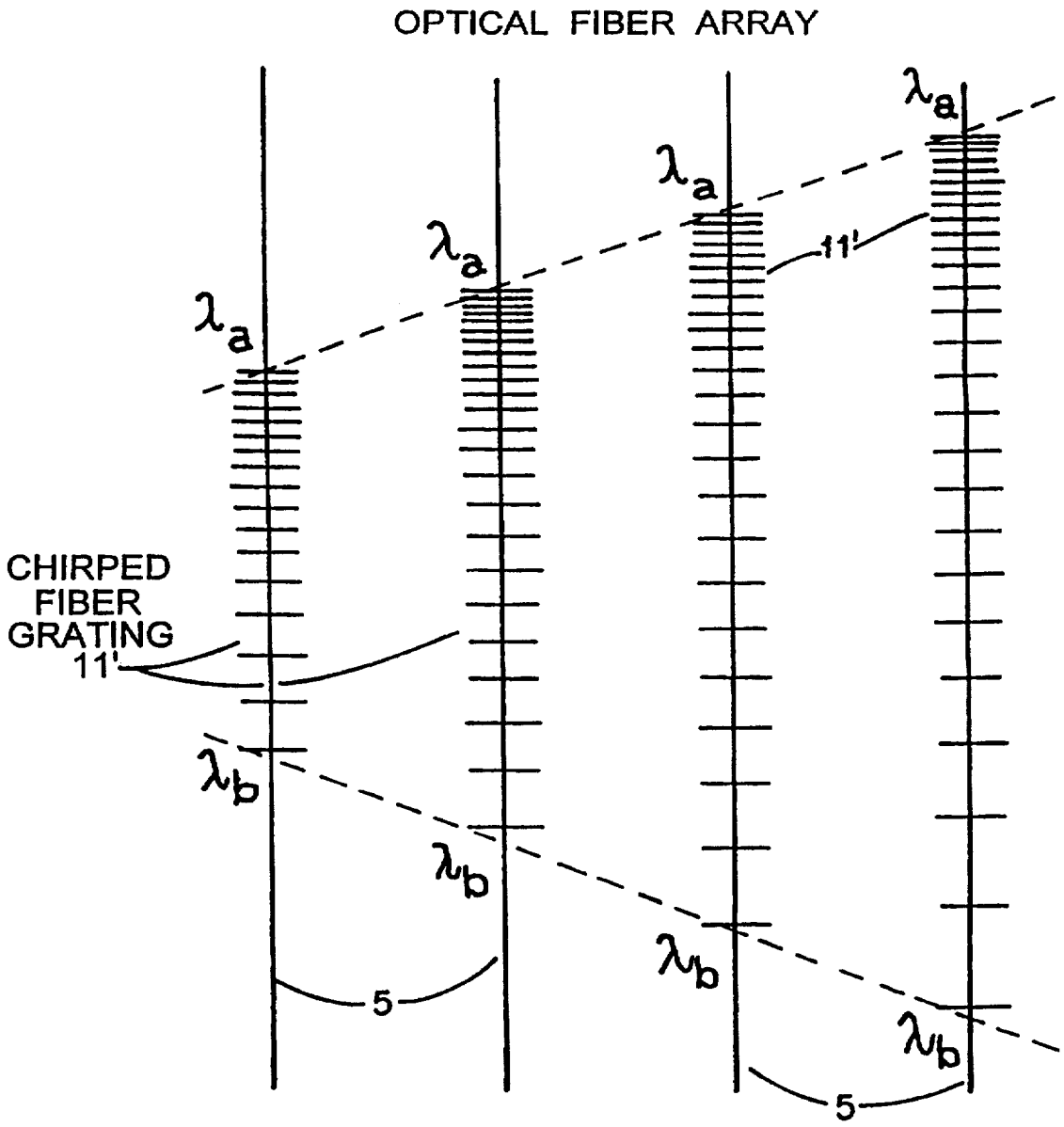
Figure 4:
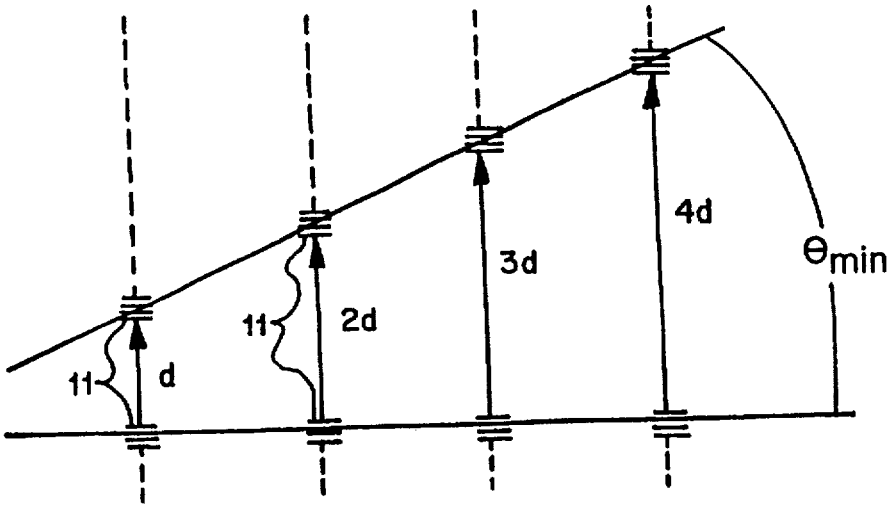
Figure 5:
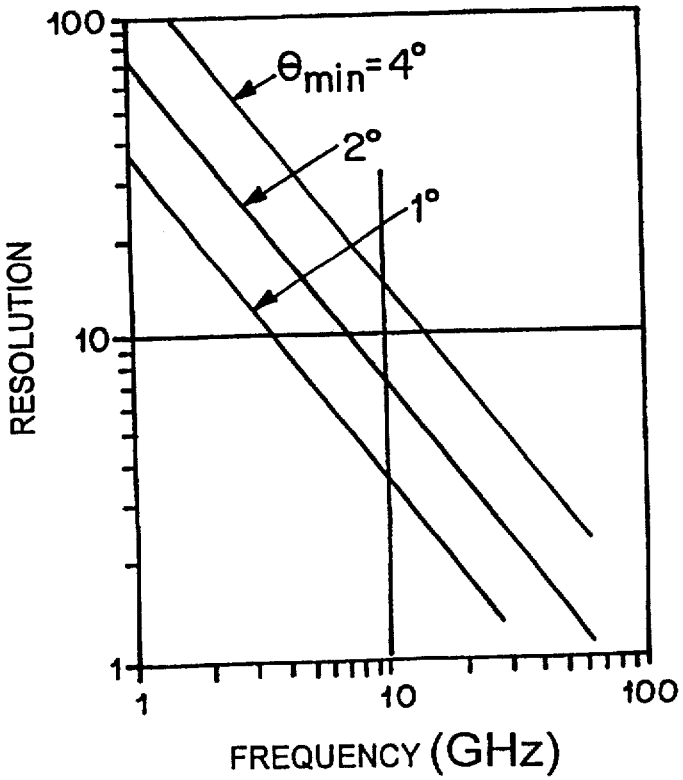
Figure 6:
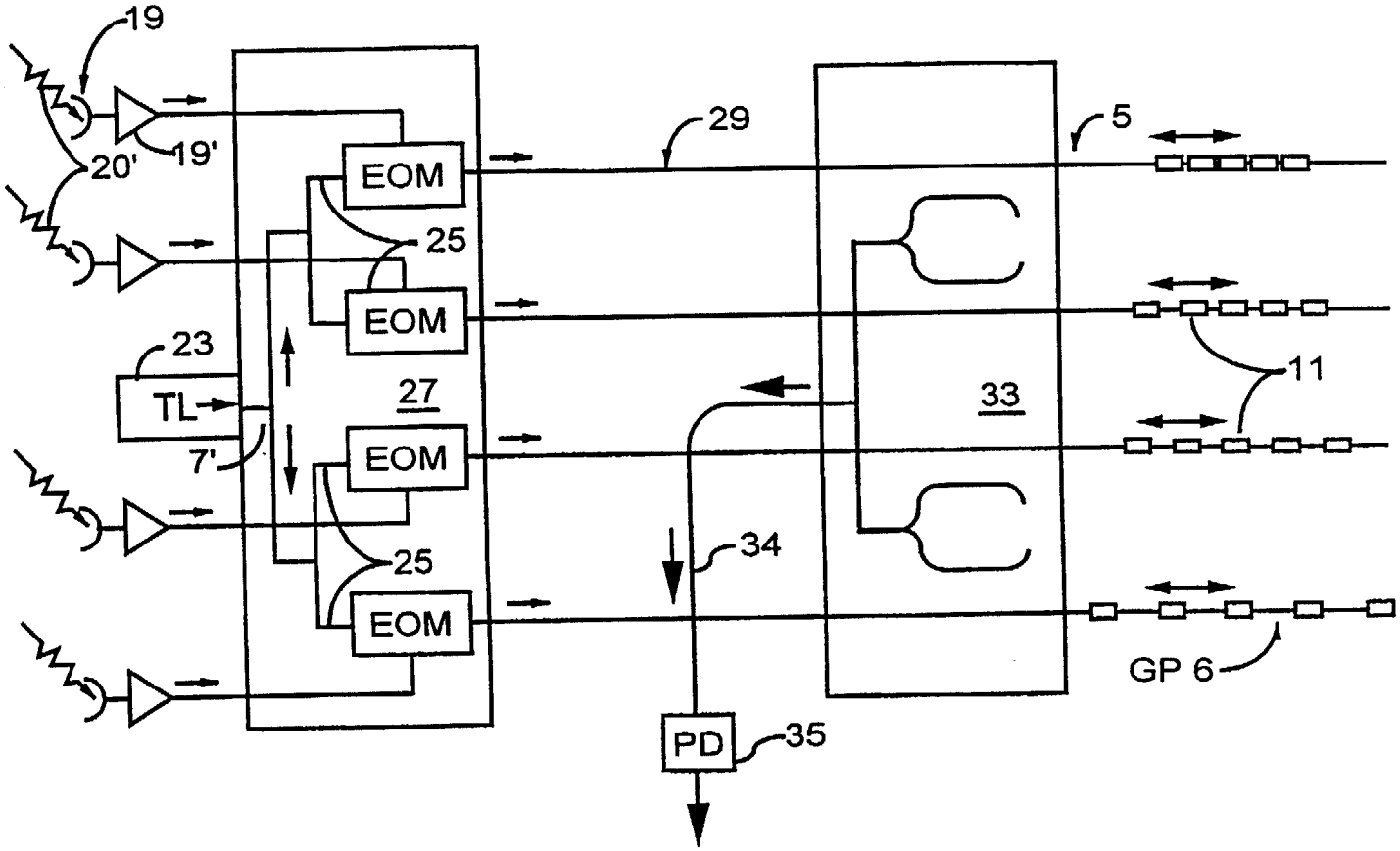
Figure 7:
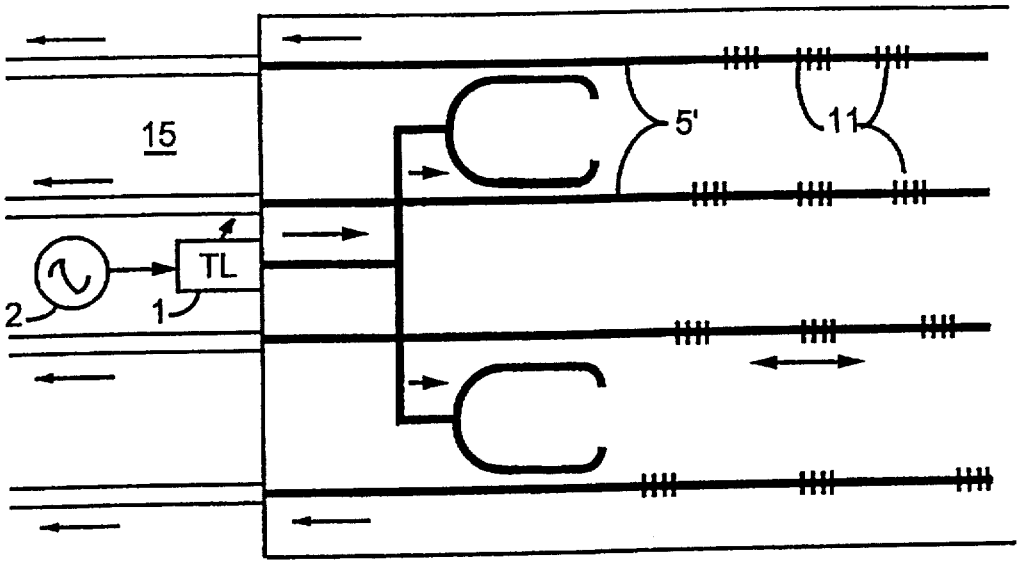
Figure 8:
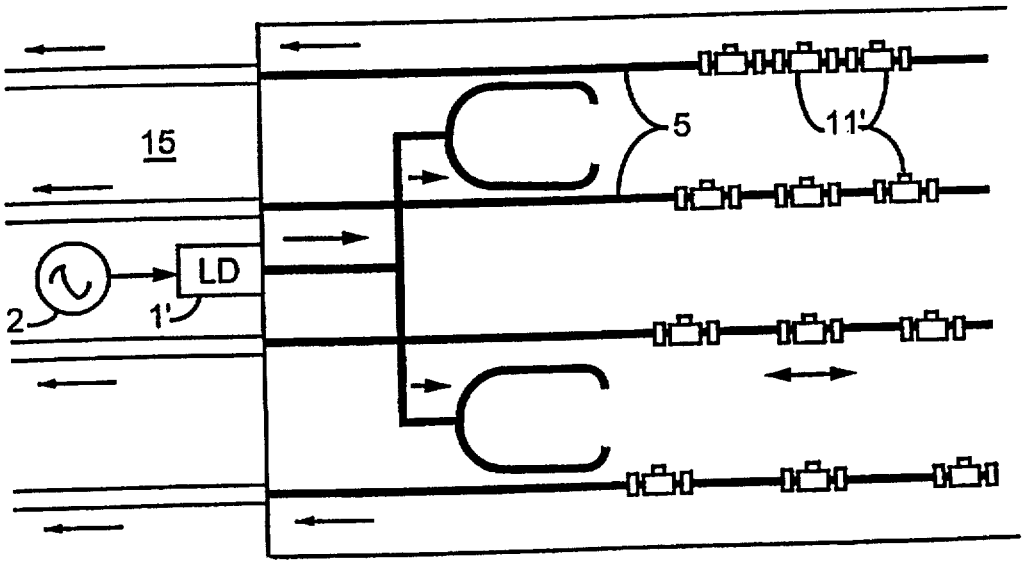
Figure 9:
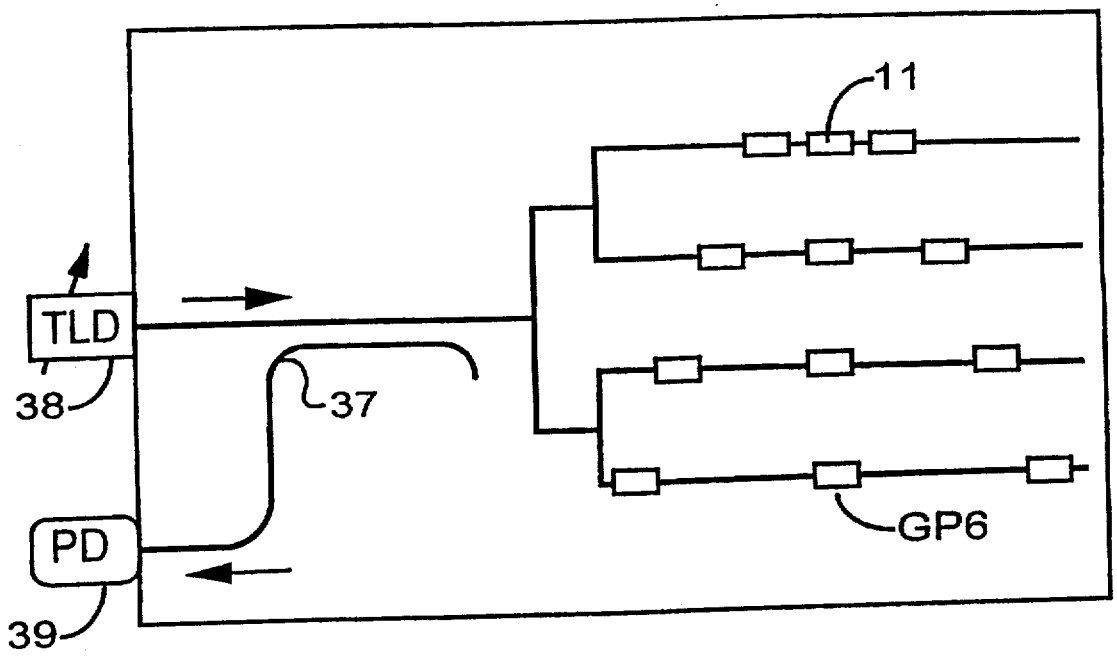
Figure 10:
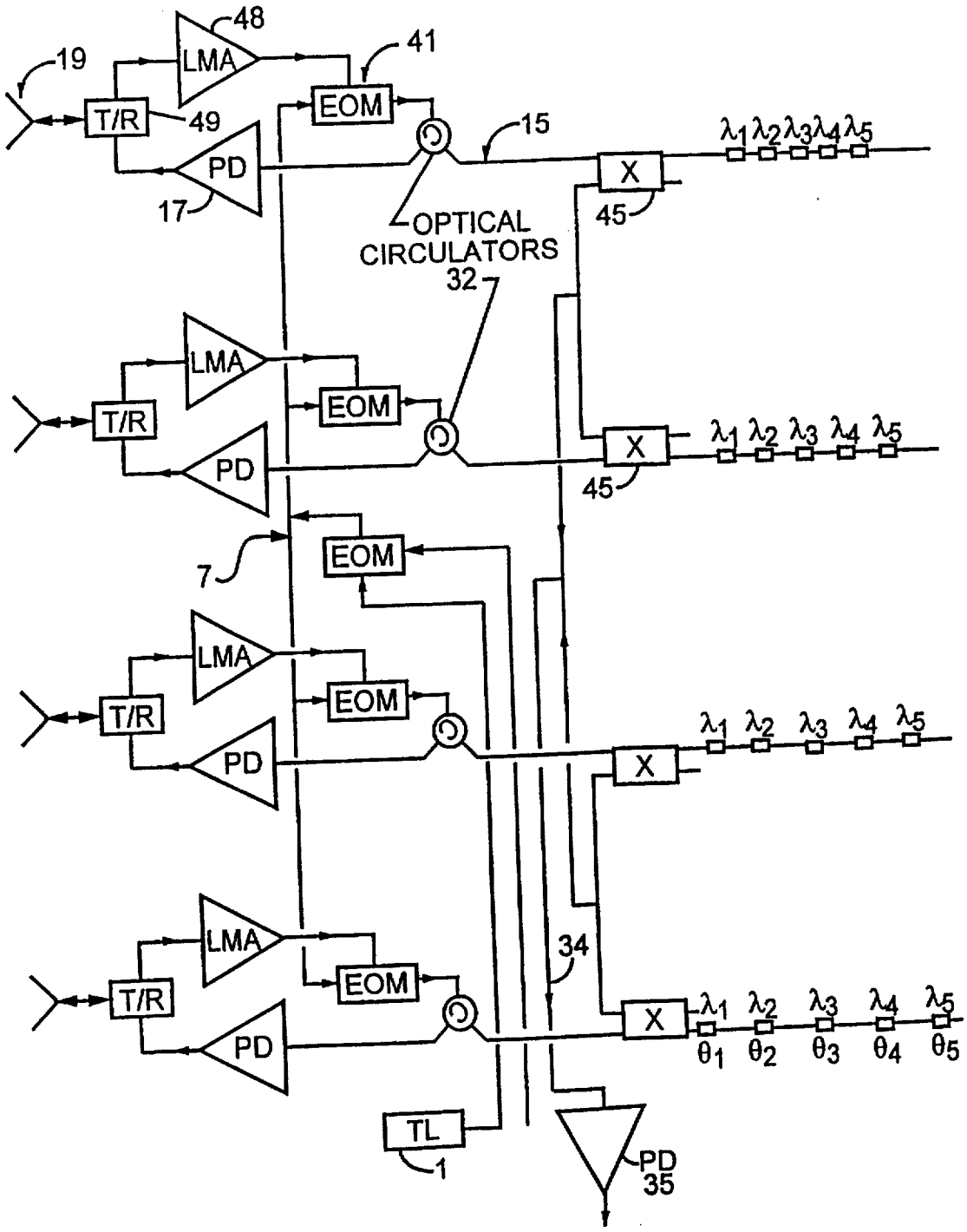

A composite transmit/receive transceiver beamformer is schematically disclosed in FIG. 10. For the transmit mode of operation, one selectively tunable laser source 1 provides a light signal to the grating prism GP 6 via 1:N power divider 7 which includes optical circulators 32 and 2×2 directional couplers 45. The delayed reflected light beams from GP6 control the antenna elements 19 as before. The receive EOMs 41, coupled to conventional transmit/receive or TR RF units 49 via amplifiers 48, are not functional in the transmit mode, but convey RF modulated light signals to optical circulators 32 in the receive mode. The 1:N power divider or splitter 7, includes an N fold set of integrated 3 dB directional couplers 45 that gather and sum the back travelling light from the gratings of GP 6 and forward these signals to a single photodiode 35 via 34 as before. Hence, reflected light is time delayed in accordance with the particular grating set addressed as previously explained. The receiver output elements 34 and 35 also function as previously described.

Measurements taken over a 3.5 Ghz bandwidth of our prototype system demonstrated high resolution beamsteering and high linear low noise phase data. The system takes advantage of component reuse and integrates the transmit and receive mode into one efficient hardware compressive topology. Further details regarding the function and performance of this system may be found in our paper authored by Henry Zmuda, Richard Soref and others entitled "PHOTONIC BEAMFORMER FOR PHASED ARRAY ANTENNAS USING A FIBER GRATING PRISM"; IEEE Photonics Technology Letters, February 1997 issue.

As other embodiments of the invention will occur to skilled workers in the art, the scope of the invention is to be defined solely by the terms of the following claims and art recognized equivalents thereof. For example, the term optical conduit is intended to include fibers and various types of optical rib waveguides mentioned above or other light transporting devices known in the art. The term "light source" can include laser diodes or any other suitable source of light known to workers in the art. The invention may be employed as a matched filter as well as a phased array antenna system.

We claim:

1. In a phased array radiant energy transmitter, the improvement comprising:

(a) a grating prism having N optical beam conduits, each conduit including a chirped Bragg grating of physical length Ln, with each continuous location along Ln capable of reflecting light at a particular wavelength within the range $\lambda_a$ to $\lambda_b$, each length Ln varying progressively from one conduit to the next conduit, N being an integer;

(b) a variable wavelength RF modulated light source means for simultaneously launching RF modulated beams of light into said N optical beam conduits, said beams having a selected wavelength associated with a particular portion of said chirped grating in each conduit to render said gratings selectively reflective at N spatial time-delay locations and to selectively address said conduits; and (c) N broad spectrum light detectors, each coupled to an associated optical beam conduit for producing an N-fold set of continuous phased-array antenna steering-angle signals upon receipt of reflected light emerging from said optical beam conduits.

2. In a phased array radiant energy transmitter, the improvement comprising:

(a) a grating prism having N optical beam conduits, each conduit including a chirped Bragg grating of physical length Ln with each continuous location along Ln capable of reflecting light at progressively ascending wavelengths along each conduit within the range $\lambda_a$ to $\lambda_b$, N being an integer;

(b) a plurality of N broad spectrum light detectors each coupled to an associated optical beam conduit for producing an N-fold set of continuous phased-array antenna steering-angle signals upon receipt of reflected light emerging from said optical beam conduits; and (c) a variable wavelength RF modulated light source means for launching RF modulated beams of light into said plurality of optical beam conduits, said beams having a selected wavelength associated with a particular portion of said chirped grating in each conduit to render said grating selectively reflective at N spatial time-delay locations and to selectively address said conduits.

3. In a phased array radiant energy receiver, the improvement comprising:

(a) a grating prism having N optical beam conduits, each conduit including a chirped Bragg grating of physical length Ln, with each continuous location along Ln capable of reflecting light at a particular wavelength within the range $\lambda_a$ to $\lambda_b$, N being an integer;

(b) variable wavelength light source means for simultaneously launching RF modulated beams of light into said N optical beam conduits, said beams having a selected wavelength associated with a particular portion of said chirped grating in each conduit to render said gratings selectively reflective at N spatial time-delay locations and to selectively address said conduits;

(c) N broad spectrum light detector means coupled to all of said optical beam conduits for producing a collective output signal upon the receipt of reflected light emerging from said optical conduits and (d) N electro-optical modulator means, one for each conduit means, with ~1/N of the light from the variable wavelength source being launched into the input port of each modulator, with an RF signal from each receiving module of the N-element antenna being fed into the electrical input port of said modulator, and with the optical output port of each modulation being coupled to said beam conduct.

4. In a phased array radiant energy receiver as defined in claim 3 further including means to function as a transceiver, the improvement comprising:

(a) N microwave transmit/receive switches connected to said receiver, one switch located at each radiator in an N-element antenna plane with each transmit arm coupled to an electrical output of a broad spectrum light detector, and each receive arm coupled to an electrooptical modulator electrical input;

(b) a cw variable wavelength light source means of said receiver coupled to one transmit electro-optic modulator whose optical output is divided into N optical signals, each of which is sent to one of N electro-optic receive modulators, with a RF transmit signal being fed into the transmit electro-optic modulator with said transmit modulator being turned off during the receive mode;

(c) N optical circulator means connected to an N-fold modulator means, and to N-fold chirped grating time-delay network and to an N-fold optical receive-path output; and (d) broad spectrum light detector means which gathers a collective optical signal from the outputs of said N-fold circulator to produce an electrical receive signal.

5. A programmable transversal filter comprising:

(a) a grating prism having N optical beam conduits, each conduit including a chirped Bragg grating of physical length Ln, with each continuous location along Ln capable of reflecting light at a particular wavelength within the range $\lambda_a$ to $\lambda_b$, each length Ln varying progressively from one conduct to the next conduit, N being an integer;

(b) a variable wavelength RF modulated light source means for simultaneously launching RF modulated beams of light into said N optical beam conduits, said beams having a selected wavelength associated with a particular portion of said chirped grating in each conduit to render said gratings selectively reflective at N spatial time-delay locations and to selectively address said conduits;

(c) N coupler means for gathering the N reflected light signals from said conduits; and (d) one broad-spectrum light detector coupled to the N reflected light signals and responding to the combined N-fold delayed optical signals, the electrical output of said detector containing a composite RF signal whose spectrum is variably filtered with respect to the RF spectrum coming into the variable wavelength light source.

* * * * *

UNITED STATES PATENT AND TRADEMARK OFFICE

CERTIFICATE OF CORRECTION

PATENT NO. : 6,114,994
DATED : September 5, 2000
INVENTOR(S) : Richard A. Soref et al.

It is certified that error appears in the above-identified patent and that said Letters Patent is hereby corrected as shown below:

The enclosed are the correct drawings for this Patent.

Signed and Sealed this

Twenty-first Day of August, 2001

Nicholas P. Godici

*Attest:*

*Attesting Officer*

NICHOLAS P. GODICI
*Acting Director of the United States Patent and Trademark Office*

United States Patent [19]

Soref et al.

[11] Patent Number: 6,114,994

[45] Date of Patent: Sep. 5, 2000

[54] PHOTONIC TIME-DELAY BEAMSTEERING SYSTEM USING FIBER BRAGG PRISM

[75] Inventors: Richard A. Soref, Newton, Mass.; Henry Zmuda, Niceville, Fla.

[73] Assignee: The United States of America as represented by the Secretary of the Air Force, Washington, D.C.

[21] Appl. No.: 08/961,450

[22] Filed: Oct. 30, 1997

[51] Int. Cl.[7] ..... H01Q 03/22

[52] U.S. Cl. ..... 342/372; 342/375

[58] Field of Search ..... 342/372, 375

[56] References Cited

U.S. PATENT DOCUMENTS

| | | | |
|---|---|---|---|
| 4,717,918 | 1/1988 | Finken | 342/368 |
| 4,962,382 | 10/1990 | Lee | 342/372 |
| 5,140,651 | 8/1992 | Soret et al. | 385/2 |
| 5,461,687 | 10/1995 | Brock | 385/37 |
| 5,583,516 | 12/1996 | Lembo | 342/375 |
| 5,852,687 | 12/1998 | Wickham | 385/14 |

*Primary Examiner*—Mark Hellner

*Attorney, Agent, or Firm*—Robert L. Nathans

[57] ABSTRACT

A one-laser technique for optical time-delay beamsteering of a microwave phased-array antenna in transmit-and- receive modes. Arrays of reflective, fiber Bragg gratings are employed and a modulated, wavelength-tuned laser excites prism-shaped arrays of chirped or single-frequency gratings deployed inside a set of N parallel fibers. The fiber gratings can be replaced by waveguided gratings within a semiconductor chip for operation at high microwave frequencies.

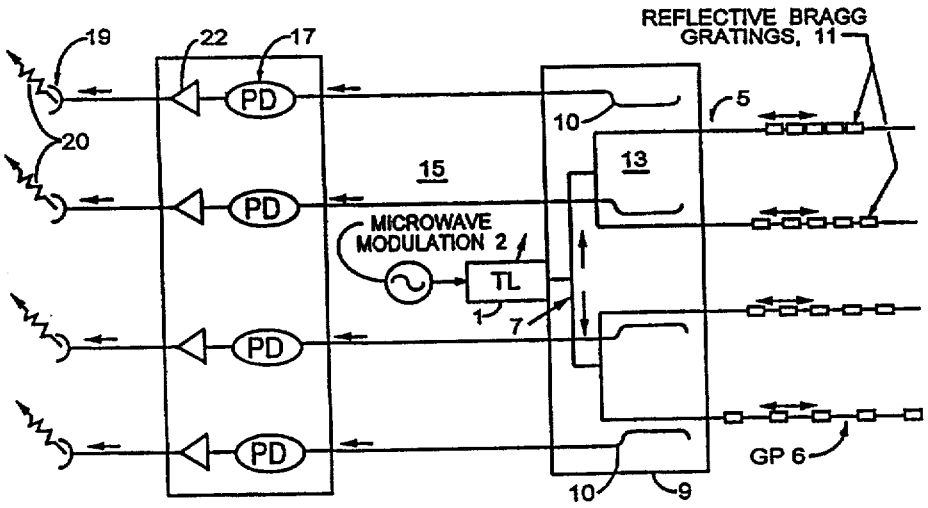

5 Claims, 11 Drawing Sheets